US012252299B2

(12) United States Patent
Kohara et al.

(10) Patent No.: US 12,252,299 B2
(45) Date of Patent: Mar. 18, 2025

(54) CONTAINER BAG FOR LIQUID HAVING A SPOUT

(71) Applicant: DAIWA CAN COMPANY, Chiyoda-ku (JP)

(72) Inventors: Hidetomo Kohara, Sagamihara (JP); Tsuyoshi Kawabata, Sagamihara (JP); Susumu Sato, Sagamihara (JP); Yuka Tozaki, Sagamihara (JP)

(73) Assignee: DAIWA CAN COMPANY, Chiyoda-ku (JP)

( * ) Notice: Subject to any disclaimer, the term of this patent is extended or adjusted under 35 U.S.C. 154(b) by 232 days.

(21) Appl. No.: 17/996,053

(22) PCT Filed: Mar. 30, 2021

(86) PCT No.: PCT/JP2021/013561
§ 371 (c)(1),
(2) Date: Oct. 12, 2022

(87) PCT Pub. No.: WO2021/210387
PCT Pub. Date: Oct. 21, 2021

(65) Prior Publication Data

US 2023/0331439 A1 Oct. 19, 2023

(30) Foreign Application Priority Data

Apr. 15, 2020 (JP) ..... 2020-073072

(51) Int. Cl.
*B65D 75/00* (2006.01)
*B65D 30/08* (2006.01)
(Continued)

(52) U.S. Cl.
CPC ..... *B65D 29/02* (2013.01); *B65D 75/5872* (2013.01); *B65D 83/0022* (2013.01)

(58) Field of Classification Search
CPC .. B65D 75/008; B65D 75/52; B65D 75/5877; B65D 75/5883; B65D 29/02; B65D 83/0022
(Continued)

(56) References Cited

U.S. PATENT DOCUMENTS 8,960,183 B2 * 2/2015 Husson, Jr. ..... C02F 1/001 220/592.01
2013/0248540 A1 * 9/2013 Darby ..... B65D 75/5877 229/5.5
(Continued)

FOREIGN PATENT DOCUMENTS

JP 2003-026184 A 1/2003
JP 2010-280397 A 12/2010
(Continued)

OTHER PUBLICATIONS

International Search Report issued Jun. 15, 2021 in PCT/JP2021/013561 filed on Mar. 30, 2021, 3 pages.

*Primary Examiner* — Charles P. Cheyney
(74) *Attorney, Agent, or Firm* — Oblon, McClelland, Maier & Neustadt, L.L.P.

(57) ABSTRACT

To prevent a reduction in a bending strength and a buckling strength of a container bag for fluid in which a spout is mounted on an upper end of a trunk section formed of a sheet material. Cells 9 are formed between two films of the sheet material 2 by bonding the films together along bonding lines 8, and inflated with fluid. The cells 9 positioned within a width of the spout in a width direction of the trunk section 5 extends downwardly from a site at which the spout 6 is clamped by the layers of the sheet material 2. A lower end of the spout 6 is situated lower than upper ends of the cells 9.

4 Claims, 7 Drawing Sheets

(51) Int. Cl.
*B65D 75/58* (2006.01)
*B65D 83/00* (2006.01)

(58) Field of Classification Search
USPC ..... 222/105, 93, 94; 383/109
See application file for complete search history.

(56) References Cited

U.S. PATENT DOCUMENTS

| | | | | |
|---|---|---|---|---|
| 2016/0220065 | A1* | 8/2016 | Brusatori | A47J 36/28 |
| 2019/0185213 | A1* | 6/2019 | Kodama | B65D 33/02 |
| 2019/0248546 | A1* | 8/2019 | Inagawa | B65D 37/00 |
| 2021/0309429 | A1 | 10/2021 | Kohara et al. | |
| 2022/0324624 | A1* | 10/2022 | Kodama | B32B 27/20 |
| 2023/0108758 | A1* | 4/2023 | Shiba | B65D 75/5877 383/109 |
| 2023/0150743 | A1* | 5/2023 | Otsuka | B65D 75/008 383/109 |

FOREIGN PATENT DOCUMENTS

| | | | |
|---|---|---|---|
| JP | 2011-006137 | A | 1/2011 |
| JP | 2015-042553 | A | 3/2015 |
| JP | 2016-531057 | A | 10/2016 |
| JP | 2018-095267 | A | 6/2018 |
| JP | 2018-144856 | A | 9/2018 |
| JP | 2020-033025 | A | 3/2020 |
| JP | 2021-155045 | A | 10/2021 |

* cited by examiner

CONTAINER BAG FOR LIQUID HAVING A SPOUT

TECHNICAL FIELD

The present invention relates to a container bag for liquid in which cells formed in side walls and a bottom wall are filled with fluid such as air to secure the strength to retain a posture, and more specifically, to a container bag having a nozzle apparatus including a spout for dispensing liquid.

BACKGROUND ART

The container bag of this kind is sterically formed by folding a synthetic resin sheet. Therefore, it is possible to reduce use of synthetic resin thereby reducing environmental burdens. For this reason, the container bag of this kind is useful to contain liquid for daily use. A rigidity or strength of the container bag of this kind may be enhanced by changing the number of cells in the side walls and the bottom wall, and adjusting a filling pressure of the fluid into the cells. Therefore, the container bag of this kind is expected be provided with a metered dispensing system to serve more than a container bag.

Japanese Patent Laid-Open No. 2011-6137 discloses one example of a packing bag having a metered dispensing system. The packing bag described in Japanese Patent Laid-Open No. 2011-6137 is formed by folding a thermoplastic resin sheet into a bag, and bonding a periphery of the bag. Therefore, a rigidity or strength of the packing bag is very low. A spout is inserted into an upper periphery of the packing bag and bonded with the sheet. A pump dispenser is inserted into the spout, and a tube extends from a main body of the pump dispenser to the vicinity of a bottom of the packing bag to pump up the content. An abutment body is attached to a lower end of the tube to be brought into contact with the bottom of the packing bag. That is, since the packing bag described in Japanese Patent Laid-Open No. 2011-6137 does not have a sufficient strength or rigidity to sustain its form against a vertical load applied thereto, the abutment body receives a load derived from pushing down the pump dispenser.

Japanese Patent Laid-Open No. 2015-42553 discloses another example of a packing bag to which a vertical load or a pushing load is not applied directly. According to the teachings of Japanese Patent Laid-Open No. 2015-42553, the packing bag is suspended on a stand by engaging a spout on which a pump dispenser is mounted so that the load to push down the pump dispenser is received by the stand. Therefore, the packing bag is not subjected to the load when dispensing the content.

SUMMARY OF INVENTION

Technical Problem to be Solved by the Invention

Thus, both of the packing bags described in Japanese Patent Laid-Open No. 2011-6137 and Japanese Patent Laid-Open No. 2015-42553 are sterically formed by combining the synthetic resin sheets, therefore, it is possible to reduce use of synthetic resin. However, in the packing bag described in Japanese Patent Laid-Open No. 2011-6137, a special structure of the tube of the pump dispenser and an extra strength of the packing bag are required to realize the metered dispensing function. That is, additional members are required, and hence the use of synthetic resin has to be increased. In addition, even though the packing bag is made of the synthetic resin sheet, waste of the bag after use increases. Thus, the packing bag described in Japanese Patent Laid-Open No. 2011-6137 is not eco-friendly enough.

The packing bag described in Japanese Patent Laid-Open No. 2015-42553 also has the above-explained problems. That is, the additional stand is indispensable to realize the metered dispensing function. Therefore, as the packing bag described in Japanese Patent Laid-Open No. 2011-6137, the use of synthetic resin has to be increased, and waste of the bag after use increases. Thus, the packing bag described in Japanese Patent Laid-Open No. 2015-42553 is also not eco-friendly enough.

In the prior art, there is known a technique to secure the strength or rigidity of a container bag made of sheet material by inflating cells formed in walls with air. Specifically, the sheet is tensioned by a pressure of the air in the cells as sealed compartments thereby enhancing a bending strength and a compression strength. However, if the cell as a sealed compartment is too large, the cell swells excessively inwardly thereby reducing a capacity of the container bag. In order to avoid such disadvantage, a plurality of cells is formed in the wall of the container bag.

However, the air pressure and the tension of the sheet material are not applied to a partition area extending between the cells, and hence the container back would be bent or buckled by an external force at the partition area. Therefore, it is required to enhance the bending strength and the compression strength of the container bags inflated with fluid such as air.

The present invention has been conceived noting the above-explained technical problems, and it is therefore an object of the present invention to provide a container bag in which cells are inflated with fluid to enhance a bending strength or rigidity, and in which a rigidity or strength of a portion deformed by a nozzle apparatus is secured or enhanced.

Means for Solving the Problem

According to the present invention, there is provided a container bag for liquid having a spout. In the container bag, a closed trunk section is formed by folding a sheet material in which at least two films are laminated together, and bonding peripheries of layers of the sheet material overlapped on each other. The spout has a higher rigidity than a rigidity of the sheet material, and the spout is clamped by the layers of the sheet material in an upper periphery of the trunk section while communicating with an internal space of the trunk section. In order to achieve the above-explained objectives, according to the present invention, a cell is formed between the films of the sheet material forming a side wall of the trunk section by bonding the films together along a straight or curved bonding line, and fluid is injected into the cell to inflate the cell. Specifically, a portion of the cell formed within a width of the spout in a width direction of the trunk section extends downwardly from a site at which the spout is clamped by the layers of the sheet material. In addition, a lower end of the spout is situated lower than an upper end of the cell.

According to the present invention, the lower end of the spout may be clamped by the cells inflated with the fluid.

Advantageous Effects of Invention

In the container bag for fluid according to the present invention, a plurality of cells is formed in the trunk section by bonding the films of the sheet material along the bonding line, and each of the cells is inflated with the fluid. The upper ends of the layers of the sheet material clamping the spout are bonded to the spout. In the trunk section, the cells are also formed within the width of the spout, and those cells extend downwardly from the site at which the spout is clamped by the layers of the sheet material. In addition, the lower end of the spout is situated lower than an upper end of the cell in the internal space of the trunk section. That is, the spout is partially overlaps with the cells. Therefore, when the boundary between the site at which the spout is bonded to the layers of the sheet material and the cells is buckled, a reaction force established by the cells inflated with the fluid is applied to the portion of the spout extending downwardly from the above-mentioned boundary thereby preventing a deformation of the trunk section. Specifically, the lower portion of the spout is clamped by the cells inflated with the fluid so that the spout is supported strongly by the cells. Therefore, deformation and buckling at the boundary between the cells and the spout, in other words, at the upper ends of the cells. For this reason, bending strength and the buckling strength of the container bag are enhanced.

DESCRIPTION OF EMBODIMENT(S)

Embodiments of the present invention will now be explained with reference to the accompanying drawings. Note that the embodiments shown below are merely examples the present invention, and do not limit the present invention.

Figure 1:
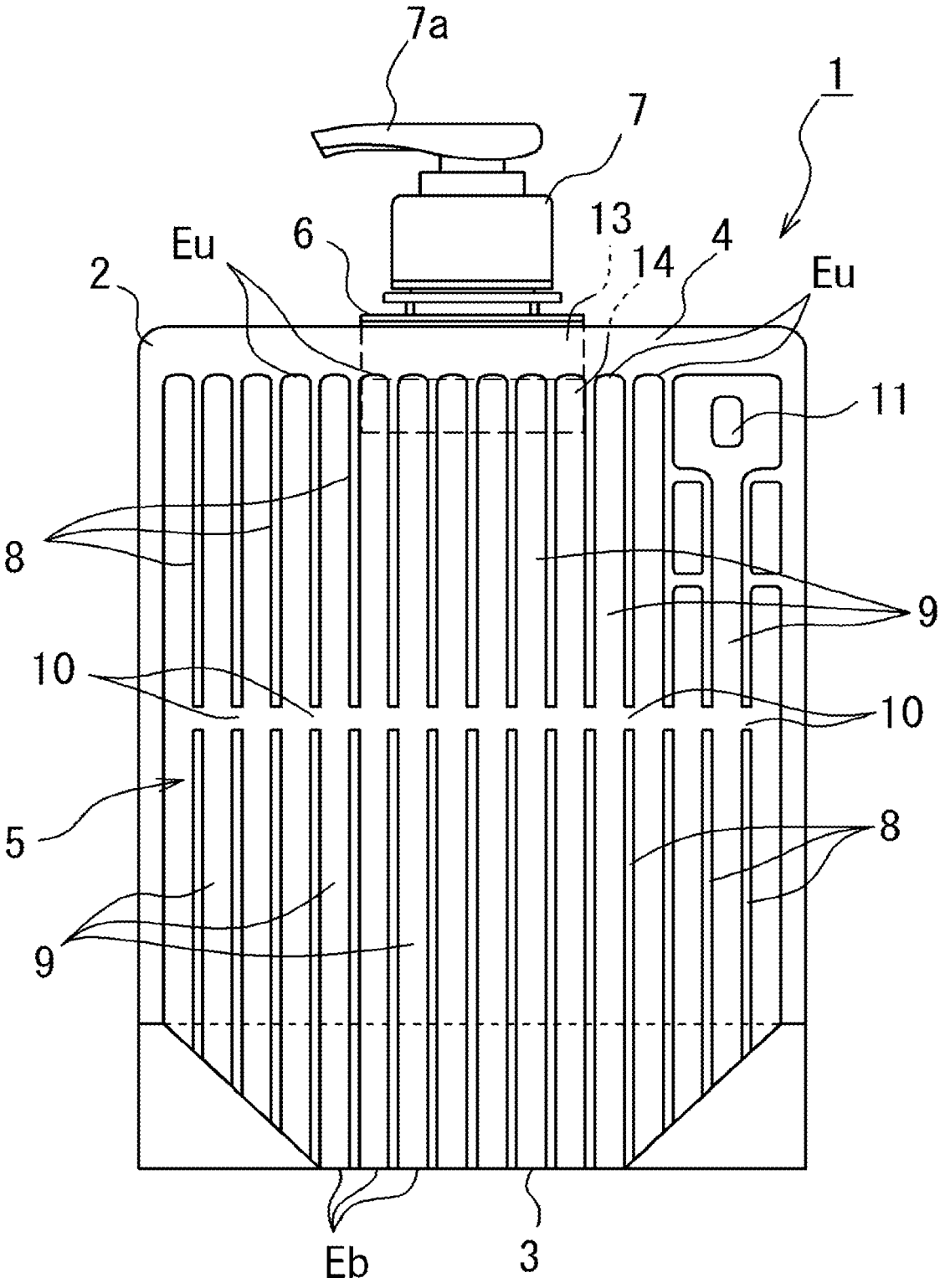
FIG. 1 is a front view schematically showing one example of the container bag for fluid according to the exemplary embodiment of the present invention.

Turning now to FIG. 1, there is schematically shown one example of a container bag for liquid (simply referred to as the container bag hereinafter) according to the present invention. The container bag 1 is formed by folding a sheet material 2 into halves along a longitudinal center, and (thermally) bonding peripheral layers overlapping each other. Consequently, a bottom section 3 having certain dimensions is formed between layers of the sheet material 2. In the container bag 1, layers of an upper periphery 4 extending on an opposite side to the bottom section 3 are (thermally) bonded to each other so that a trunk section 5 is formed between the bottom section 3 and the upper periphery 4 in the height direction of the container bag 1. A spout member 6 made of synthetic resin is attached to the center of the upper periphery 4 in the width direction. A rigidity of the spout member 6 is higher than that of the sheet material 2, and a not shown cap or an after-mentioned pump dispenser is mounted on the spout member 6. In the following explanations, the spout member 6 will be simply referred to as the spout 6.

Figure 2:
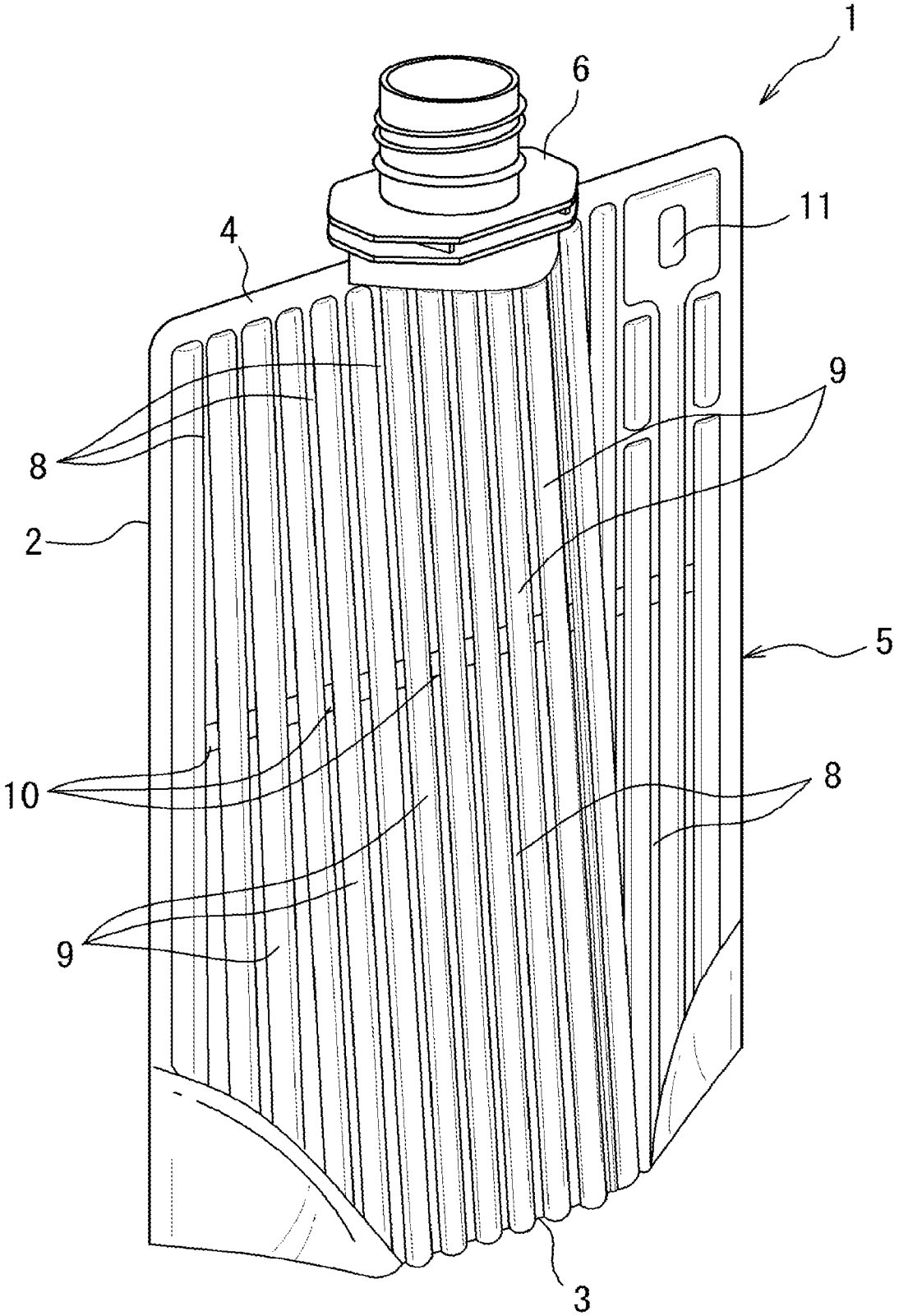
FIG. 2 is a perspective view schematically showing the container bag from which a pump dispenser is dismounted.

The spout 6 serves not only as an inlet from which the content is injected into the container bag 1, but also as an outlet from which the content is dispensed. Specifically, the spout 6 has a through hole communicating an internal space of the container bag 1 with outside so that the content is injected into the container bag 1 through the through hole, and the content is dispensed from the container bag 1 through the through hole. According to the embodiment, a pump dispenser 7 that dispenses the content while pressurizing is mounted on the spout 6. Although not illustrated in detail, as the conventional one, a piston is pushed down by pushing a nozzle head 7*a* to discharge the content from a nozzle through a cylinder, and pulled up by returning the nozzle head 7*a* to suck up the content held in the container bag 1 into the cylinder through a suction tube. In FIG. 2, there is shown the container bag 1 from which the pump dispenser 7 is dismounted.

Figure 3:
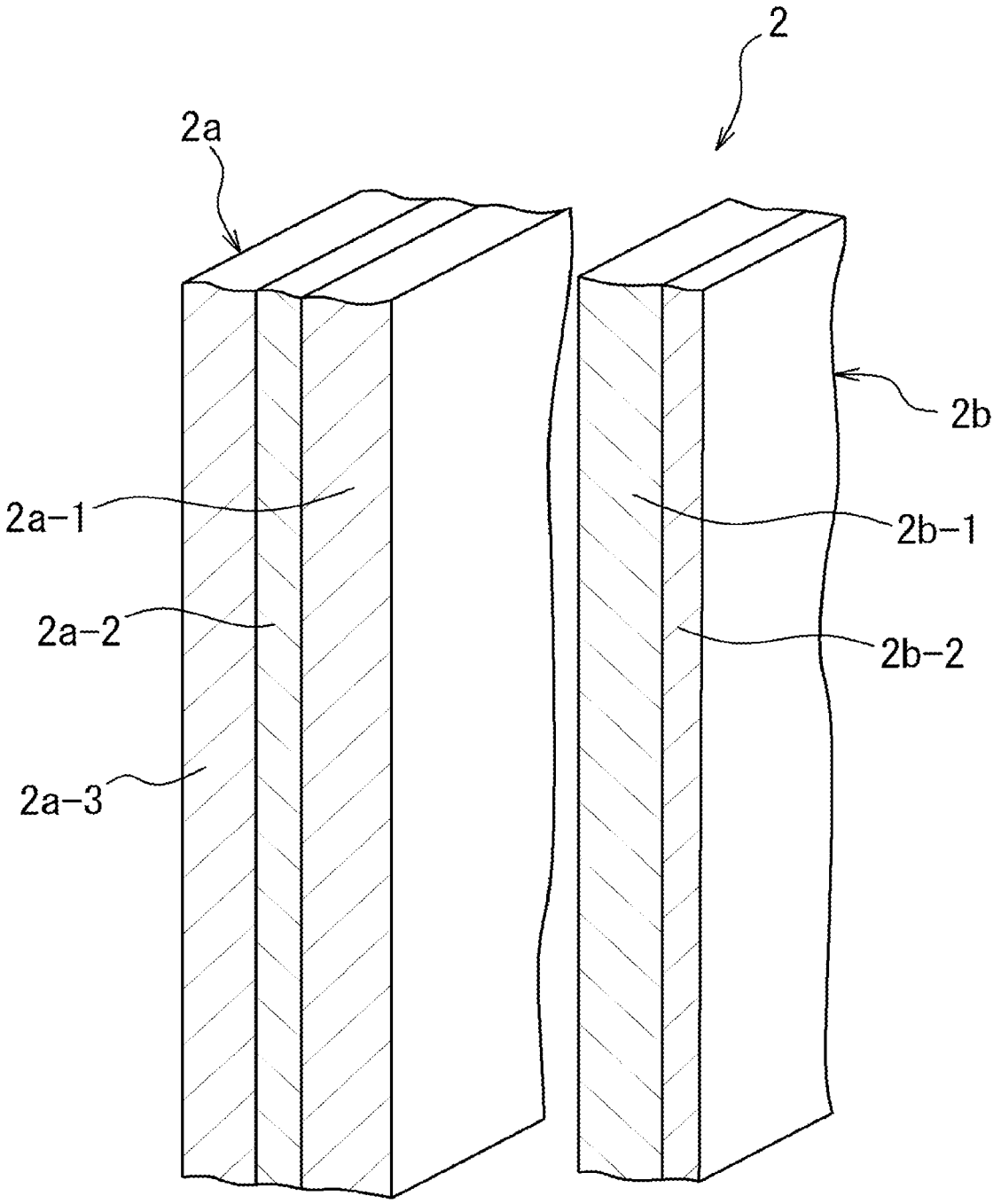
FIG. 3 is a partially enlarged perspective view partially showing films.

Here will be explained the sheet material 2. As illustrated in FIG. 3, the sheet material 2 has a two-layered structure comprising an inner film 2*a* and an outer film 2*b*. Specifically, a thickness of the inner film 2*a* is approximately 150 μm. The inner film 2*a* comprises: a bonding layer 2*a*-1 that is thermally bonded (or laminated) to the outer film 2*b*; a barrier layer 2*a*-2 that prevents permeation of gas; and an inner layer 2*a*-3 as an innermost layer being in contact with the content. As the bonding layer 2*a*-1, it is preferable to employ a heat-sealing thermoplastic resin film. For example, a polyolefin series resin film and a polyester series resin film may be adopted as the bonding layer 2*a*-1, and a linear low-density polyethylene (abbreviated as LLDPE hereinafter) resin film is especially suitable for the bonding layer 2*a*-1.

The barrier layer 2*a*-2 is adapted to prevent permeation of e.g., oxygen, moisture, aroma substance, and is formed of a resin film or coating whose barrier property against oxygen gas is less than that against other kinds of gas. In a case of forming the barrier layer 2*a*-2 using the coating, a coating material composed mainly of synthetic resin having a barrier property against oxygen and moisture is applied to the bonding layer 2*a*-1 or the inner layer 2*a*-3, and then the coating is cured. In a case of forming the barrier layer 2*a*-2 using the resin film, an ethylene-vinylalcohol copolymer resin film may be adopted as the barrier layer 2*a*-2. As the inner layer 2*a*-3, a heat-sealing thermoplastic resin film such as a polyolefin series resin film and a polyester series resin film may also be employed, and an LLDPE resin film is especially suitable for the inner layer 2*a*-3.

On the other hand, a thickness of the outer film 2*b* is approximately 60 μm. The outer film 2*b* comprises: a base layer 2*b*-1 that is thermally bonded (or laminated) to the inner film 2*a*; and an outer layer 2*b*-2 as an outermost layer in the container bag 1. As the base layer 2*b*-1, it is also preferable to employ a heat-sealing thermoplastic resin film. For example, a polyolefin series resin film and a polyester series resin film may also be adopted as the base layer 2*b*-1, and an LLDPE resin film is especially suitable for the base layer 2*b*-1. In a case of employing the LLDPE resin film as the base layer 2*b*-1, the base layer 2*b*-1 may be bonded easily and firmly to the bonding layer 2*a*-1, compared to a case of employing other kinds of resin film as the base layer 2*b*-1. As the outer layer 2*b*-2, for example, a polyamide series resin film, a polyolefin series resin film, and a polyester series resin film may be employed, and a Nylon (trademark) resin film is especially suitable for the outer layer 2*b*-2.

The inner film 2*a* and the outer film 2*b* are not bonded together entirely, but only their peripheral area is bonded together. In the sheet material 2, a plurality of cells 9 are defined by a plurality of bonding lines 8 at which the inner film 2*a* and the outer film 2*b* are bonded together, and the cells 9 are filled with liquid. In the example shown in FIGS. 1 and 2, each of the bonding lines 8 extends linearly. Specifically, the cells 9 are inflated with fluid at a predetermined pressure (e.g., at 0.25 MPa) so that the inner film 2*a* and the outer film 2*b* are tensioned to establish a bending strength and a buckling strength of the container bag 1.

In the container bag 1 according to the present invention, rigidities of the trunk section 5 and the bottom section 3 are enhanced by the cells 9. In the container bag 1 shown in FIG. 1, the buckling strength of the container bag 1 is enhanced to bear the load applied thereto when pushing down the pump dispenser 7 to dispense the content. To this end, the bonding lines 8 extend linearly in the longitudinal direction of the sheet material 2. Consequently, the cells 9 extending in the height direction of the container bag 1 are formed substantially entirely in the trunk section 5. Whereas, in the bottom section 3, the cells 9 extends in the thickness direction of the container bag 1. In addition, as depicted in FIGS. 1 and 2, a width or breadth of each of the cells 9 is constant from an upper end Eu to a lower end Eb. Upper ends Eu of the cells 9 are flush with one another to form a boundary with respect to the upper periphery 4 in the width direction of the container bag 1, and lower ends Eb are flush with a boundary between the trunk section 5 and the bottom section 3. That is, each of the cells 9 serves as a thin fluid chamber individually extending linearly in the height direction of the container bag 1, and none of the bonding lines 8 intersect with the cells 9. In the trunk section 5, the cells 9 are connected to one another through a passage 10 as an air passage formed by not bonding or laminating the films 2*a* and 2*b* between the cells 9.

Next, here will be explained the bottom section 3. The bottom section 3 having a predetermined width is formed across a center line of the sheet material 2 in the longitudinal direction, and the cell(s) 9 is/are formed on the center of the bottom section 3. In the situation where the cells 9 have not yet been filled with the fluid, the bottom section 3 is folded into two layers along the center line of the sheet material 2 to protrude toward an internal space of the container bag 1. Consequently, each boundary between the bottom section 3 and the trunk section 5 is folded into two layers to individually protrude toward outside of the container bag 1. Thus, as depicted in FIG. 1, the bottom section 3 is folded into an inverse V-shape. In the bottom section 3 thus folded, each pair of the layers of the inner film 2*a* being opposed to each other in side end of the bottom section 3 are linearly bonded together along the diagonal solid line shown in FIG. 1. In addition, each side periphery of the bottom section 3 is linearly bonded together in the height direction of the container bag 1. Consequently, a pair of flaps is formed on each bottom corner of the container bag 1. Therefore, the lower section of the container bag 1, that is, a portion of the trunk section 5 close to the bottom section 3 will not be expanded excessively even after the container bag 1 is filled with the content. In other words, an area of the bottom section 3 may be maintained to a designed area after filling the container bag 1 with the content.

The liquid such as air is injected into the cells 9 from an inlet hole 11. The inlet hole 11 is formed on the sheet material 2 to be communicated with any one of the cells 9. Specifically, the inlet hole 11 is formed on any one of (a side section of) the layers of the sheet material 2 being opposed to each other to serve as the trunk section 5 so as to inject the fluid into the cells 9 formed between the inner film 2*a* and the outer film 2*b*. More specifically, in the container bag 1 shown in FIG. 1, the inlet hole 11 is formed on the outer film 2*b* in the vicinity of one of upper corners of the container bag 1 below the pump dispenser 7. As illustrated in FIG. 1, one of the cells 9 extending below the inlet hole 11 is joined to the inlet hole 11. After filling the cells 9 with the fluid, the cell 9 joined to the inlet hole 11 is bonded to be closed off.

Figure 4:
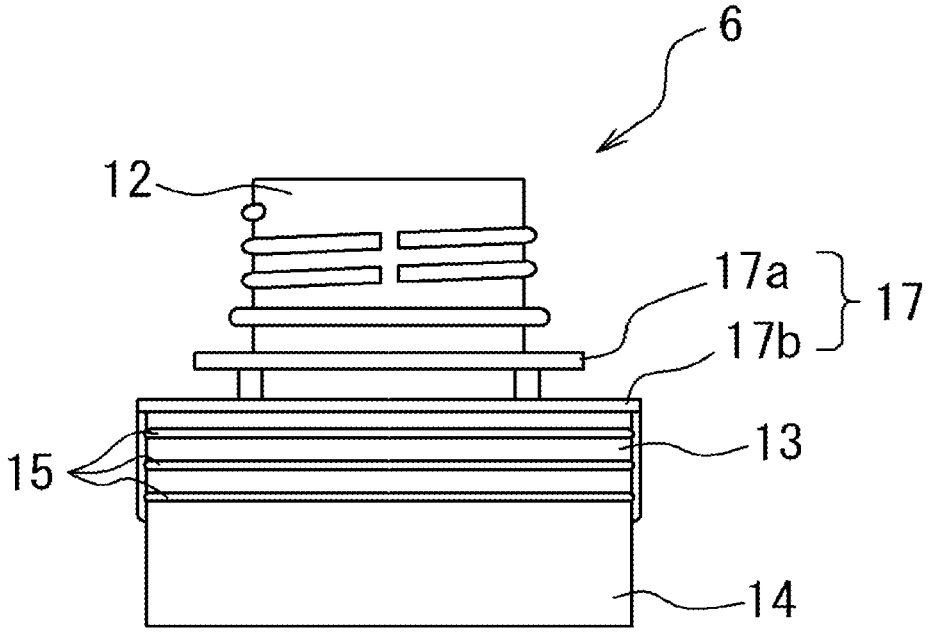
FIG. 4 is a front view showing one example of a spout according to the exemplary embodiment of the present invention.
Figure 5:
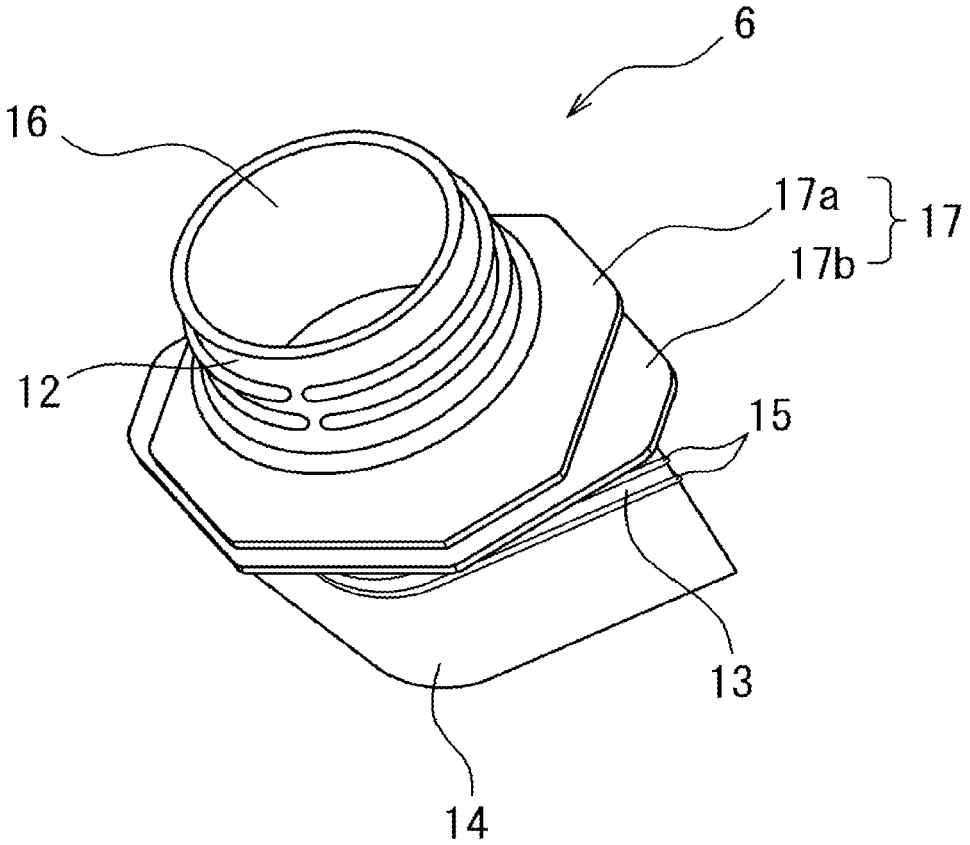
FIG. 5 is a perspective view showing the spout.

Next, the spout 6 will be explained hereinafter. FIG. 4 is a front view showing one example of the spout 6 according the exemplary embodiment of the present invention, and FIG. 5 is a perspective view of the spout 6. As illustrated in FIGS. 4 and 5, the spout 6 comprises a cylindrical neck portion 12 on which a male thread is formed, and a base portion 13 formed below the neck portion 12. The base portion 13 is joined to the sheet material at least partially, and the pump dispenser 7 is mounted on the neck portion 12. Otherwise, a not shown cap may also be mounted on the neck portion 12 to close the container bag 1.

As described, the base portion 13 is joined (e.g., bonded) to the sheet material at least partially. Specifically, the sheet material 2 is folded into two layers along the center line in the longitudinal direction so that the inner film 2*a* of those layers overlap on each other, and an upper portion of the base portion 13 is inserted between peripheries of the layers of the sheet material 2 overlapping on each other. Thereafter, as illustrated in FIG. 1, the upper portion of the base portion 13 is joined (e.g., bonded) to the above-mentioned peripheries as the upper peripheries 4 of the layers of the sheet material 2.

Figure 6:
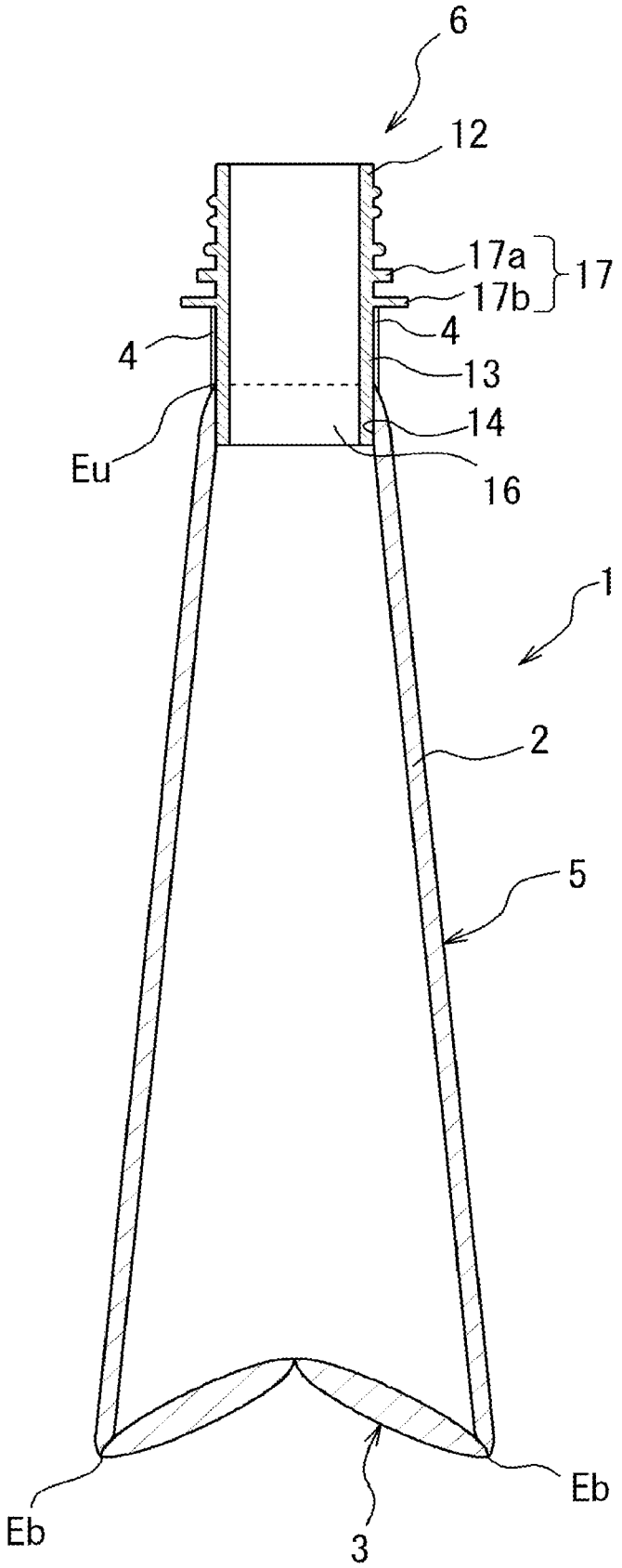
FIG. 6 is a cross-sectional view showing a cross-section of the container bag on which the spout is mounted.

Turning FIG. 6, there is shown a cross-section of the container bag 1 according to one example of the present invention. As described, the upper portion of the base portion 13 is bonded to the upper peripheries 4 of the layers of the sheet material 2. Consequently, as illustrated in FIG. 6, the upper ends Eu of the cells 9 and the upper peripheries 4 of the layers of the sheet material 2 are situated above a lower end of a skirt portion 14 formed below the base portion 13 within the width of the pump dispenser 7. In the example shown in FIG. 6, specifically, the upper ends Eu and the upper peripheries 4 are situated at an intermediate portion of the base portion 13 in the height direction. That is, the skirt portion 14 of the base portion 13 is enclosed by the upper ends Eu of the cells 9 so that the skirt portion 14 and the upper ends Eu of the cells 9 come into contact with each other in the thickness direction of the trunk section 5. The skirt portion 14 is not bonded to the upper ends Eu of the cells 9, but clamped by the cells 9 inflated with the fluid such as air.

In order to secure a joint area between the base portion 13 and the sheet material 2 and to eliminate a clearance therebetween, as illustrated in FIG. 5, the base portion 13 has a streamline shape extending in the width direction of the container bag 1. In addition, a plurality of grooves 15 are formed on an outer circumferential surface of the base portion 13 to increase the contact tightness between the base portion 13 and the sheet material 2. In the example shown in FIG. 5, the grooves 15 are formed on the outer circumferential surface of the base portion 13 at regular intervals in an axial direction of the spout 6, and each of the grooves 15 expands radially outwardly.

Figure 7:
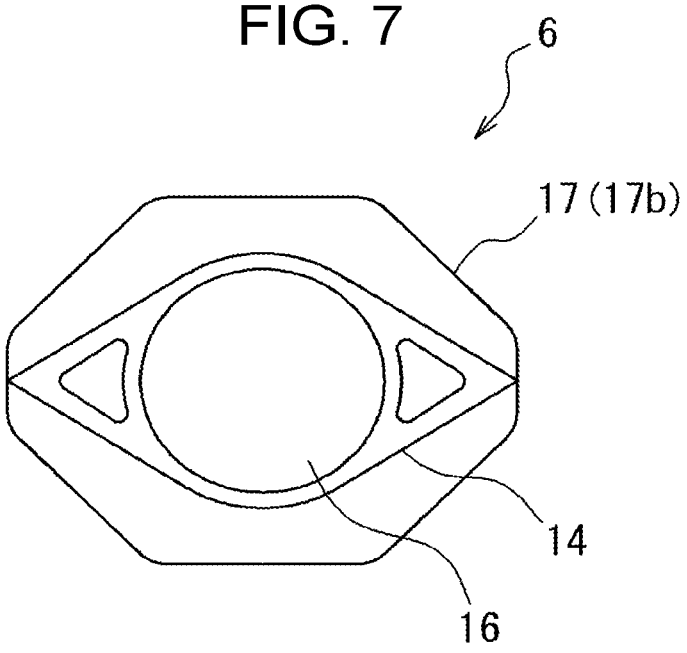
FIG. 7 is a bottom view showing a bottom of the spout.

The skirt portion 14 has a substantially same shape as the upper portion of the base portion 13. In other words, an external form of the skirt portion 14 is substantially identical to that of the base portion 13 except for the grooves 15. That is, the skirt portion 14 is an extension of the upper portion of the base portion 13. FIG. 7 is a bottom view of the spout 6. As illustrated in FIG. 7, the skirt portion 14 has a rhombic or parallelogram shape. Specifically, both corners in the width direction of the container bag 1 along the upper peripheries 4 are sharp corners, and the remaining corners in the thickness direction of the container bag 1 are rounded corners each of which is curved smoothly.

Figure 8:
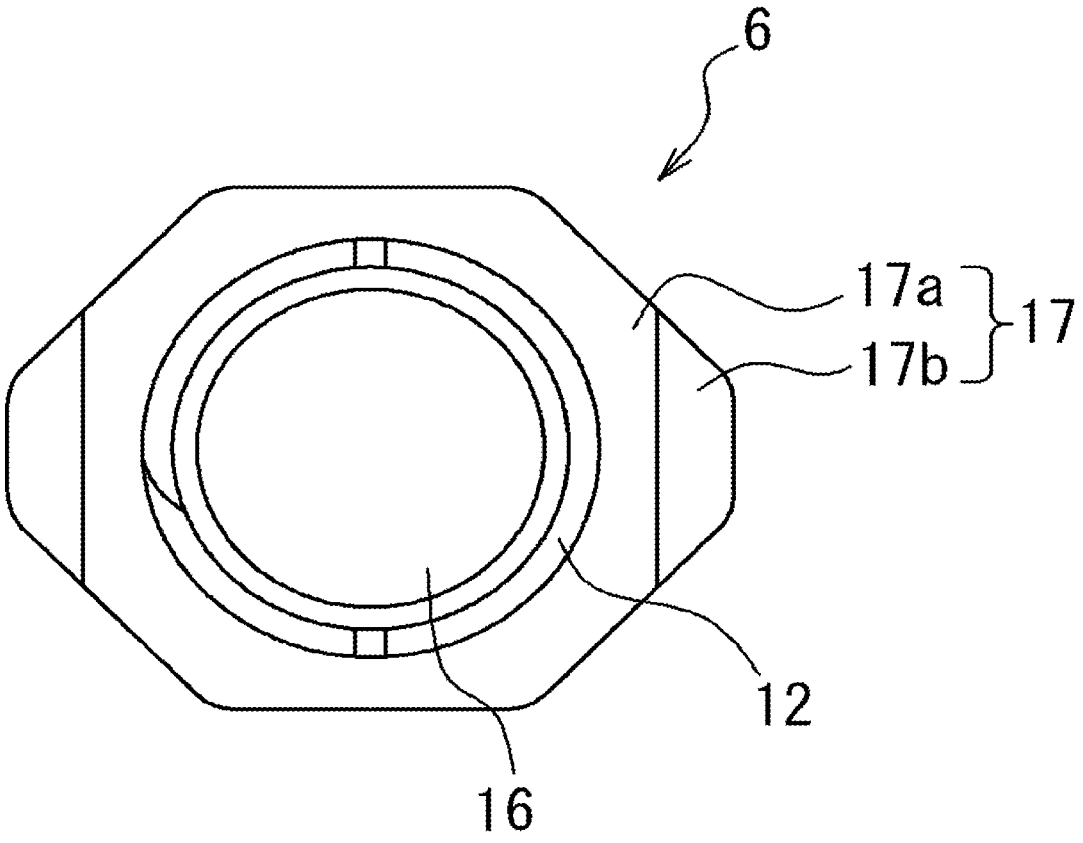
FIG. 8 is a top view showing a top of the spout.

A through hole 16 penetrating through the neck portion 12 and the base portion 13 is formed in the center of the spout 6 so that the content is injected into the container bag 1 through the through hole 16. The pump dispenser 7 is inserted into the through hole 16 at least partially so that the content is dispensed from the pump dispenser 7 through the through hole 16. In addition, a pair of flanges 17 is formed between the neck portion 12 and the base portion 13 while maintaining a predetermined clearance therebetween in the height direction. FIG. 8 is a top view of the spout 6. As illustrated in FIG. 8, a first flange 17*a* is formed above the second flange 17*b*, and each of the flanges 17*a* and 17*b* has a rounded octagonal shape. A width of the second flange 17*b* is longer than that of the first flange 17*a*, that is, a flat area of the second flange 17*b* is larger than that of the first flange 17*a*. The flanges 17*a* and 17*b* are used to transport the spout 6 and to inject the content into the container bag 1. Specifically, the spout 6 is transported by clamping a polygonal or round cylindrical portion between the flanges 17*a* and 17*b*, and the content is injected into the container bag 1 from the through hole 16 while clamping the spout 6.

Next, here will be explained an advantageous effect of the container bag 1 thus far explained. The fluid such as air is injected into the container bag 1 through the inlet hole 11, and then, a predetermined portion of the cell 9 joined directly to the inlet hole 11 is bonded linearly thereby disconnecting the cell 9 from the inlet hole 11. Consequently, the cells 9 formed in the trunk section 5 and the bottom section 3 being communicated with one another are inflated and tensioned by a pressure of the fluid injected into the cells 9. As a result, a repulsion force against an external force such as a bending force and a buckling force is established by the cells 9. In other words, a stress counteracting a bending force and a buckling force is increased. In addition, the sheet material 2 including the films 2*a* and 2*b* in which the cells 9 are formed is tensioned so that each of the cells 9 is brought into a self-sustaining condition.

In this situation, if the nozzle head 7*a* of the pump dispenser 7 is pushed down (repeatedly), a pushing force applied to the nozzle head 7*a* is transmitted as a buckling load to the container bag 1. In the boundary between: the joint area between the sheet material 2 and the spout 6; and the upper periphery 4, that is, in the boundary between the joint area between the sheet material 2 and the spout 6; and the upper ends Eu of the cells 9, the joint area has a planer structure. On the other hand, each of the cells 9 has a three-dimensional structure. Thus, the structure of the container bag 1 is changed significantly at the above-mentioned boundary. That is, the stress would concentrate on the above-mentioned boundary, and hence the container bag 1 would be buckled or deformed at the above-mentioned boundary. If the spout 6 is inclined with respect to the trunk section 5 at the above-mentioned boundary, the skirt portion 14 of the spout 6 will push the cells 9 clamping the skirt portion 14. In other words, the cells 9 establish a reaction force in a direction to prevent an inclination of the spout 6. Such action is similar to an action performed by a structure in which the cells 9 or the trunk section 5 and the spout 6 are formed integrally. That is, the above-mentioned boundary that is easily to be bent or buckled by the stress concentrated thereon is reinforced by the cells 9. Thus, in the container bag 1, the lower end portion of the spout 6 extends between the layers formed of the cells 9 so that the buckling strength and the bending strength of the container bag 1 against the pushing load applied to the spout 6 are enhanced.

According to the present invention, therefore, the container bag 1 will not be buckled or deformed by the buckling load and the bending load so that the nozzle head 7*a* is allowed to be pushed down smoothly. In addition, the buckling strength and the bending strength of the container bag 1 are enhanced without requiring additional means. Therefore, the number of parts, a cost of material, and a manufacturing cost of the container bag 1 are not increased. In other words, the rigidity of the container bag 1 may be increased only by the sheet material 2 to prevent the deformation of the container bag 1 during the pumping operation. That is, the container bag 1 may be manufactured while conserving the earth's environment and resources.

Figure 9:
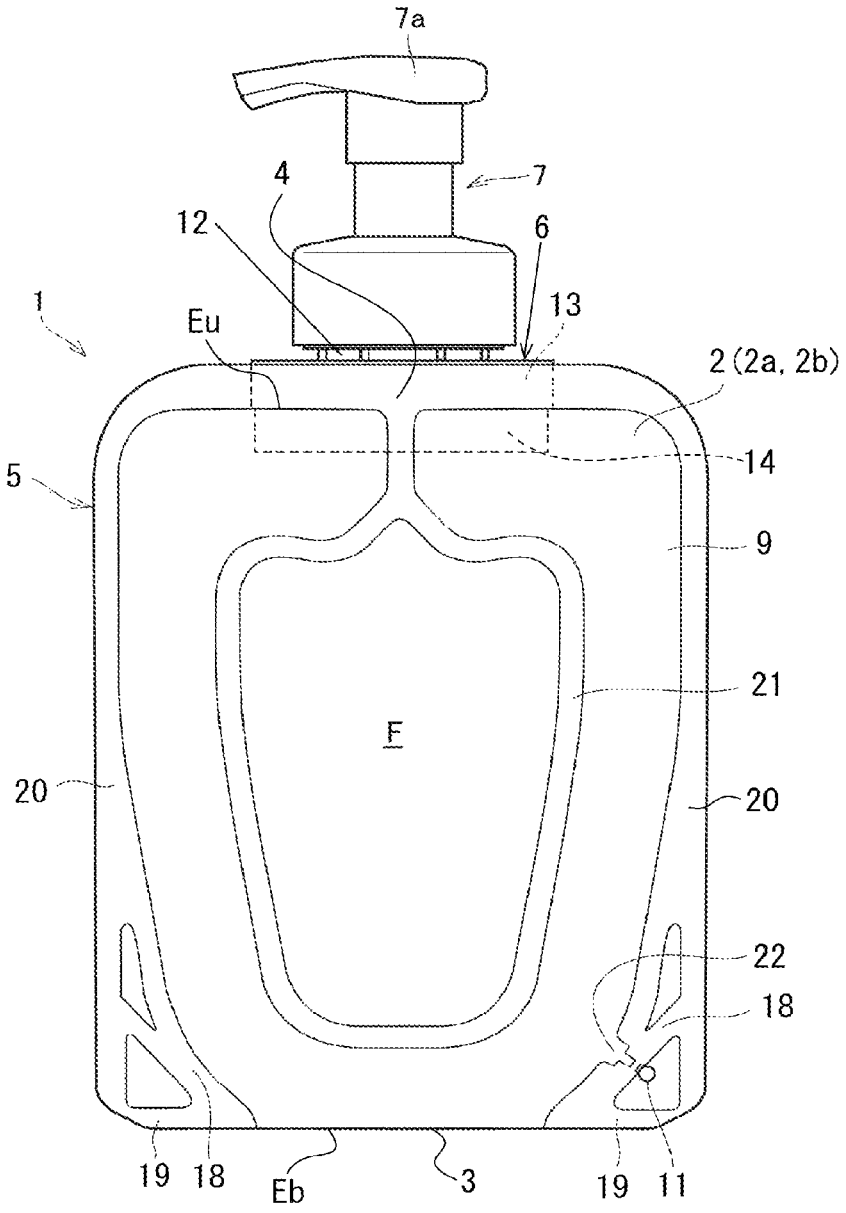
FIG. 9 is a front view schematically showing another example of the container bag for fluid according to the exemplary embodiment of the present invention.

The present invention should not be limited to the foregoing example, and configurations of the trunk section 5 and the cells 9 may be alters according to need. Turning to FIG. 9, there is shown a front view of the container bag 1 according another example in which the trunk section 5 is rounded and the cell 9 is formed into U-shape. In FIG. 9, common reference numerals are assigned to the elements in common with those of the foregoing example shown in FIGS. 1 to 8, and detailed explanations for the common elements will be omitted.

The container bag 1 shown in FIG. 9 is also formed of the sheet material 2 comprising the inner film 2*a* and the outer film 2*b* laminated to each other. The sheet material 2 is also formed into two layers, and peripheries of those layers are thermally bonded (or laminated) to each other. Both upper corners of the trunk section 5 are rounded to be shaped into shoulder sections. Whereas, both corners of the bottom section 3 are cut into arcuate corners whose curvature radii are short. In order to round an inner space for holding the content in the bottom side, layers of the sheet material 2 in the bottom side are bonded to each other along a diagonal line. A bonding line along the diagonal line will be referred to as the compartment bonding line 18. That is, the holding space for holding the content is formed inside of the compartment bonding lines 18, and triangle flaps 19 are formed outside of the compartment bonding lines 18. Thus, the holding space in which the corners are rounded is formed in the trunk section 5 by bonding the layers of the sheet material 2 along the upper periphery 4 of the trunk section 5, side peripheries 20, and the compartment bonding lines 18. Consequently, the inner film 2*a* and the outer film 2*b* are bonded to each other in the above-explained manner so that the cell 9 is formed between the inner film 2*a* and the outer film 2*b*.

The inner film 2*a* and the outer film 2*b* serving as side walls of the trunk section 5 are also bonded to each other along an annular bonding line 21 that is similar to an outline of the trunk section 5. The annular bonding line 21 is partially joined to the upper periphery 4 through a linear bonding line. Thus, the cell 9 is formed between the inner film 2*a* and the outer film 2*b* within the area between the annular bonding line 21: and the upper periphery 4; the side peripheries 20; and the compartment bonding lines 18. An area within the annular bonding line 21 is isolated liquidtightly from the cell 9 so that the cell 9 is formed into an annular shape around the annular bonding line 21. Although the inner film 2*a* and the outer film 2*b* may be bonded together entirely within the annular bonding line 21, according to the example shown in FIG. 9, the inner film 2*a* and the outer film 2*b* are merely overlapped onto each other within the annular bonding line 21 without being bonded. After the cell 9 is inflated with the fluid such as air, a central area F within the annular bonding line 21 is tensioned by the inflation of the cell 9 to be flattened.

In the container bag shown in FIG. 9, the inlet hole 11 is formed in any one of the above-mentioned flaps 19. The inlet hole 11 is connected to the cell 9 through an air passage 22 penetrating through the compartment bonding line 18. The fluid such as air is injected into the cell 9 from the inlet hole 11, and thereafter the air passage 22 is bonded to be closed.

In the upper periphery 4 of the trunk section 5, the base portion 13 of the spout 6 is inserted between the layers of the sheet material 2 overlapping on each other, and bonded to the layers of the sheet material 2. Consequently, the spout 6 is fixed to the trunk section 5. The skirt portion 14 of the spout 6 as an extension of the base portion 13 extends into the internal space for holding the content. Specifically, an upper end of the annular cell 9 is located above a lower end of (the skirt portion) of the spout 6. The cell 9 is formed on each side wall of the trunk section 5, therefore, the skirt portion 14 of the spout 6 extending downwardly from the base portion 13 is clamped by the upper ends Eu of the cells 9. Thus, the container bag 1 shown in FIG. 9 also has a structure similar to the structure in which the cells 9 or the trunk section 5 and the spout 6 are formed integrally. That is, the above-mentioned boundary that is easily to be bent or buckled by the stress concentrated thereon is also reinforced by the cells 9. Specifically, the lower end portion of the spout 6 also extends between the cells 9 so that the buckling strength and the bending strength of the container bag 1 against the pushing load applied to the spout 6 are enhanced.

In the foregoing examples, a width of the upper periphery 4 (in the height direction of the container bag 1) is identical to a bonding width of the layers of the sheet material 2 and a bonding width of the sheet material 2 and the spout 6. The skirt portion 14 of the spout 6 protrudes downwardly from the width of the upper periphery 4 so that the skirt portion 14 is clamped by the cells 9. However, the present invention should not be limited to such structurer. For example, the width of the layers of the sheet material 2 clamping the spout 6 may be reduced narrower than the bonding width of the upper peripheries 4 of the sheet material 2, and the upper end(s) Eu of the cell(s) 9 may be situated above the lower end of the spout 6. Consequently, the spout 6 may be overlapped partially with the cells 9 so that the lower portion of the spout 6 is clamped by the cells 9.

In addition, according to the present invention, the cells 9 may be shaped individually into a matrix shape instead of the linear cells extending parallel to one another. Otherwise, a width of the cell 9 may be changed gradually from the upper end to the lower end. That is, the configuration of the cell 9 may be altered arbitrarily as long as the cell 9 may be inflated by the fluid to enhance the bending strength and the buckling strength of the trunk section 5 by a tension of the cell 9. Further, the cell(s) 9 according to the foregoing examples may be formed in the sheet material 2 only within the width of the spout 6 on which the pump dispenser 7 is mounted, and another cells (i.e., fluid chambers) having different configurations may be formed in the remaining portion of the sheet material 2.

The invention claimed is:

1. A container bag for liquid having a spout, wherein a closed trunk section is formed by folding a sheet material in which at least two films are laminated together, and bonding peripheries of layers of the sheet material overlapped on each other, the spout has a higher rigidity than a rigidity of the sheet material, and the spout is clamped by the layers of the sheet material in an upper periphery of the trunk section while communicating with an internal space of the trunk section, a plurality of cells are formed between the films of the sheet material forming a side wall of the trunk section by bonding the films together along a bonding line, and fluid is injected into the cell to inflate the cell, the spout includes a base portion that is inserted between upper peripheries of the layers of the sheet material and bonded to the sheet material at least partially, the base portion includes a skirt portion that is formed below the portion bonded to the layers of the sheet material, the cells are formed between the films of each of the layers of the sheet material, at least the cell formed within a width of the spout in a width direction of the trunk section extends downwardly from the upper peripheries of the layers of the sheet material, and the skirt portion is clamped by the cells formed between the films of each of the layers of the sheet material extending downwardly within the width of the spout in the width direction of the trunk section.

2. The container bag for liquid having the spout as claimed in claim 1, wherein the spout further includes a pump dispenser having a nozzle head that is pushed down to discharge a content.

3. The container bag for liquid having the spout as claimed in claim 1, wherein the cells clamping the skirt portion extend linearly toward a bottom of the trunk section.

4. The container bag for liquid having the spout as claimed in claim 1, wherein the cells clamping the skirt portion extend linearly toward a bottom of the trunk section.

* * * * *